US007095377B2

(12) United States Patent
Lyons et al.

(10) Patent No.: US 7,095,377 B2
(45) Date of Patent: Aug. 22, 2006

(54) LIGHT-WEIGHT SIGNAL TRANSMISSION LINES AND RADIO FREQUENCY ANTENNA SYSTEM

(75) Inventors: Alan Michael Lyons, New Providence, NJ (US); Carsten Metz, Township Chatham, Morris County, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 82 days.

(21) Appl. No.: 10/697,498

(22) Filed: Oct. 30, 2003

(65) Prior Publication Data

US 2005/0093754 A1 May 5, 2005

(51) Int. Cl.
*H01Q 1/34* (2006.01)

(52) U.S. Cl. ..... 343/709

(58) Field of Classification Search ..... 343/709, 343/710, 720

See application file for complete search history.

(56) References Cited

U.S. PATENT DOCUMENTS 3,095,568 A * 6/1963 Aine et al. ..... 343/709
3,312,902 A * 4/1967 Dean et al. ..... 455/99
3,328,750 A * 6/1967 Gimber et al. ..... 367/3
3,999,183 A * 12/1976 Brett ..... 343/709
4,353,071 A * 10/1982 Bernstein et al. ..... 343/709
4,475,109 A * 10/1984 Dumas et al. ..... 343/709
4,510,500 A * 4/1985 Brune ..... 343/708
5,406,294 A * 4/1995 Silvey et al. ..... 343/709
6,512,496 B1 * 1/2003 Alexeff et al. ..... 343/915
6,573,876 B1 * 6/2003 Maroko et al. ..... 343/906
6,650,304 B1 * 11/2003 Lee et al. ..... 343/915
6,791,510 B1 * 9/2004 Watanabe et al. ..... 343/897
6,856,297 B1 * 2/2005 Durham et al. ..... 343/795

* cited by examiner

*Primary Examiner*—Wilson Lee
*Assistant Examiner*—Leith Al-Nazer

(57) ABSTRACT

A light weight antenna system and corresponding light-weight transmission lines are disclosed that are characterized as having an extremely light weight relative to prior such systems and lines. An inflatable body having an inner surface connected to an outer surface with a plurality of support structures, such as connecting tubes. Antenna elements are disposed on the outer surface of the inflatable body to form, for example, a phased array antenna. Coaxial transmission lines are used to transmit signals to and from an antenna element and are, in one embodiment, created by disposing an inner conductor within the aforementioned connecting tubes. Such a transmission line may be utilized in a number of applications, such as to connect a base station to an antenna system of a wireless communications network. In another embodiment, quasi coaxial transmission lines are formed by disposing flexible membrane shields around a transmission elements.

6 Claims, 4 Drawing Sheets

LIGHT-WEIGHT SIGNAL TRANSMISSION LINES AND RADIO FREQUENCY ANTENNA SYSTEM

FIELD OF THE INVENTION

The present invention relates generally to signal transmission lines and antenna systems and, more specifically, to light weight signal transmission lines and lightweight antenna systems.

BACKGROUND OF THE INVENTION

Light weight transmission lines and antenna systems are useful in many widely-varied applications. For example, lightweight lines and antennas may be used in an RF-based remote sensing application where objects or signals are detected or imaged from a position that may be a significant distance away from those objects or signals. In some remote sensing systems, phased-array radar systems, which are well-known in the art, have been developed to generate images of distant objects by generating a radio frequency (RF) signal and by then detecting and processing the return signal after it has "bounced" off of the distant object.

Phased array radar systems are especially suited for use in remote sensing radar applications as compared to well-known dish or slotted array antennas. Contrary to dish or slotted array antennas, which rely on a physical antenna shape and antenna pointing direction to form and steer an RF beam, phased array antennas utilize interference between multiple radiating elements to achieve beam forming and beam steering. By electronically adjusting the excitation of each element, the combined radiation pattern can be scanned and shaped at high speed and with advanced capabilities. Such phased-array antennas are characterized by very high beam agility, i.e., the beam can be moved as quickly as electronic signals can be generated across specific antenna elements. Additionally, phased array antenna systems are capable of advanced beam forming, such as forming multiple beams with the elements of one antenna. This permits, for example, tracking several moving objects at one time. In an imaging application, a phased array antenna system can be used potentially to image multiple objects, each of which is in a different location. Finally, phased array antennas are also advantageous in that they are typically very reliable. This high reliability is in part due to the fact that typical phased array antennas have no moving parts. For these reasons, phased array antennas are advantageous in ground-based, airborne and space-based radar remote sensing systems.

SUMMARY OF THE INVENTION

While prior RF-based remote sensing systems, such as those using phased array antennas, were advantageous in many aspects, they were limited in certain regards. For example, although prior phased-array systems were characterized by high beam agility and reliability, the antennas and associated supporting infrastructure, such as transmission lines, were relatively heavy. In airborne and space-based applications, this could be problematic since heavier vehicle weight leads, all else equal, to a greater fuel consumption and decreased vehicle maneuverability. In airborne applications, this would require the vehicle to refuel more often, thus limiting the time available for sensing operations. In space-based applications, this would mean the on-board fuel (which is typically limited to the fuel on board when the spacecraft was launched) would be expended faster, thus limiting the number and type of maneuvers of the spacecraft on orbit. Additionally, such relatively heavy antennas and transmission lines are not suited for use on extremely light vehicles, such as dirigibles or other lighter than air vehicles.

Therefore, the present inventors have invented a light weight antenna system and corresponding lightweight transmission lines that substantially eliminate the aforementioned problems. In one embodiment, a lightweight antenna comprises an inflatable body having an inner surface connected to an outer surface with a plurality of support structures, such as connecting tubes. Antenna elements are disposed on the outer surface of the inflatable body to form, for example, a phased array antenna. The connecting tubes can be used as transmission lines or can be used as a component in coaxial transmission lines for transmitting signals to and from the antenna elements. As formed, the lightweight antenna system is particularly suited for use on lighter than air vehicles, such as dirigibles.

The coaxial transmission lines used to transmit signals to and from an antenna element are, in one embodiment, created by disposing an inner conductor within the aforementioned connecting tubes. The surface of the tubes can be metallized to function as an outer conductor and, accordingly, to create a coaxial transmission line. The inner conductor is separated from the outer conductor by either a pressurized fluid disposed within the outer conductor or, alternatively, by using a plurality of separation structures, such as toroidal-shaped structures placed around the inner conductor. Such a transmission line is characterized by extremely light weight. Accordingly, such a transmission line may be utilized in a number of applications, such as to connect a base station to an antenna system of a wireless communications network.

In another embodiment, a quasi coaxial transmission line is used to transmit signals to and from the antenna. Such a transmission line uses a conducting transmission element disposed on the first surface of a substrate, such as the surface of a dirigible. A coaxial shield is created around the transmission element by attaching the sides of a first flexible membrane and a second flexible membrane, such as membranes manufactured out of Mylar material, to portions of the substrate surrounding the transmission element. A pressurized fluid, such as pressurized helium, is disposed within the coaxial shield to act as a dielectric between the shield and the transmission element and to keep the shield and the element separated.

DETAILED DESCRIPTION

Figure 1:
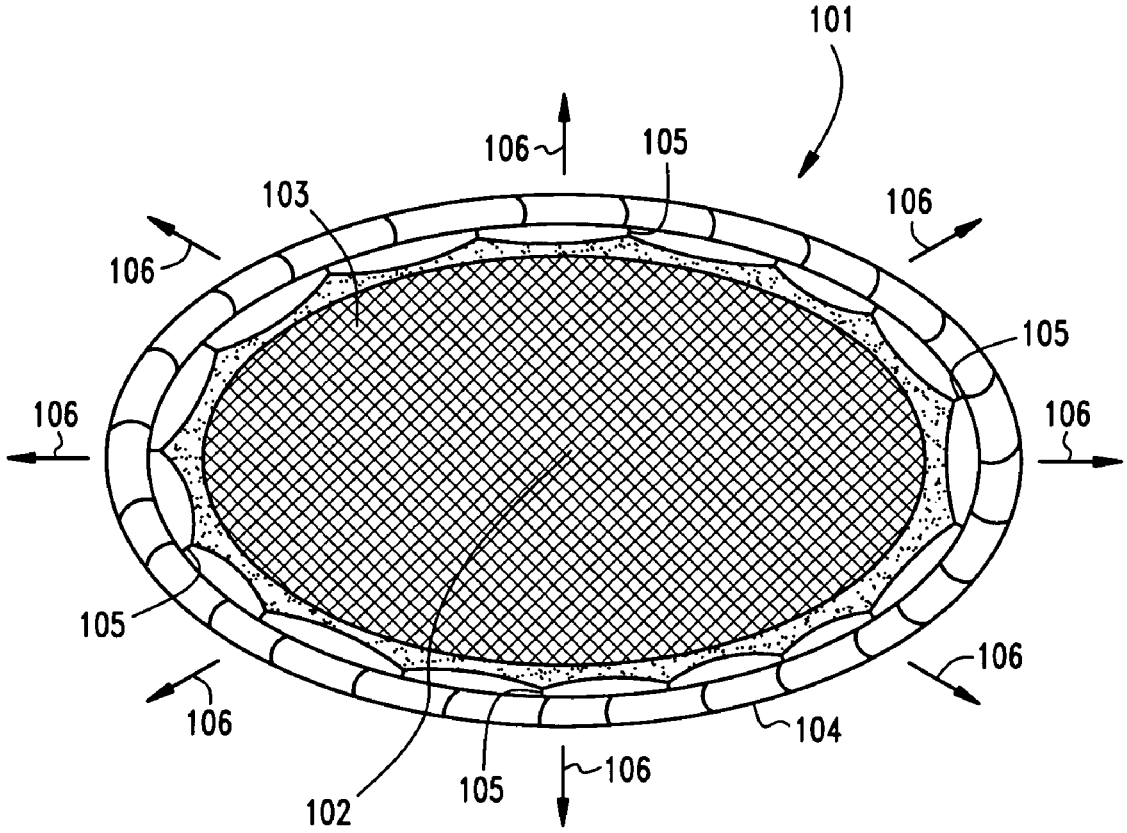
FIG. 1 PRIOR ART
FIG. 1 shows a prior art inflatable phased array antenna.

FIG. 1 shows a prior lightweight antenna structure 101 useful in RF transmission systems. In that figure, structure 101 has an antenna 102 with multiple antenna elements arranged in an array, such as is used in a phased array antenna. In certain applications, it is advantageous for the array to be substantially flat. Hence, in this prior application, the array is attached to a membrane 103 that is, in turn, connected to inflatable circular tube 104 via attachments 105. The membrane and the tube are designed such that, when tube 104 is inflated, a substantially equal amount of force is applied to membrane 103 via attachments 105. This causes membrane 103 to stretch laterally in, for example, directions 106. When the membrane 103 is sized appropriately (depending in part upon the material used for membrane 103), the resulting tension applied to membrane 103 is such that the membrane, and hence antenna array 102, becomes substantially flat.

Figure 2:
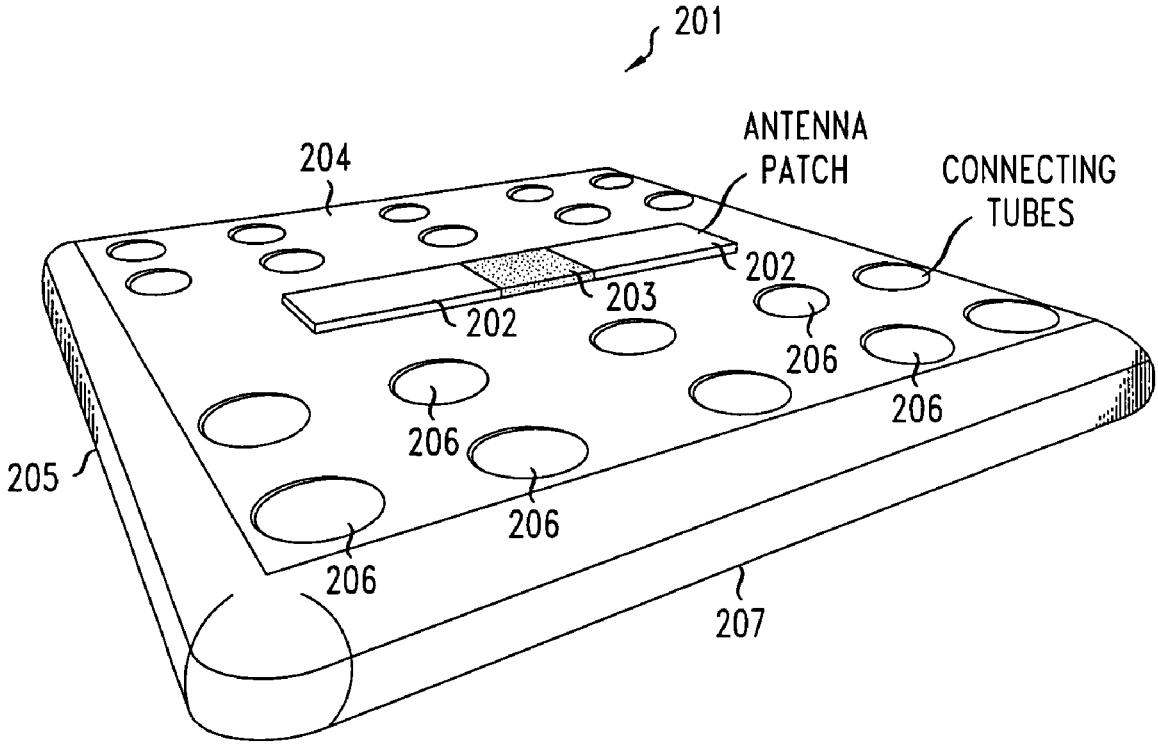
FIG. 2 shows an illustrative phased-array antenna element in accordance with the principles of the present invention.

FIG. 2 shows an embodiment of a lightweight antenna element structure 201 in accordance with the principles of the present invention. Referring to FIG. 2, antenna element 202 having illustrative radio frequency (RF) integrated circuit (IC) 203 is attached to outer surface 204. Antenna element 202 may be used, for example, to generate an RF signal in a phased array antenna. Such antennas and the electronics useful in those antennas are well known to one skilled in the art. Outer surface 204 is, for example, the top surface of an inflatable body having illustrative side walls 207 and bottom inner surface 205 (which is not visible in the view of FIG. 2). Inner surface 205 may be, for example, a metallized surface in order to serve as a ground plane for antenna element 202. Connecting tubes 206 function to connect outer surface 204 with inner surface 205 and to maintain a desired distance between those two surfaces, which is especially useful if inner surface 205 is used as a ground plane. Outer surface 204, inner surface 205, connecting tubes 206 and sides 207 are, illustratively, manufactured from a polyester film, such as a Mylar film, which is well known in the art. As is also well known, Mylar is a biaxially oriented, thermoplastic film made from ethylene glycol and dimethyl terephthalate (DMT) and is characterized by advantageous mechanical properties such as a relatively constant stiffness, strength, toughness, moisture-resistance and dimensional stability over a wide range of temperatures. Because of these properties, Mylar is extremely resistant to puncturing and tearing and, therefore, is a useful illustrative material from which to manufacture an inflatable body. The antenna element of FIG. 2 is merely illustrative in nature and may, for example, be used in combination with a plurality of antenna elements to form an array of antenna elements.

One illustrative use for the lightweight antenna element structure described above and shown in FIG. 2 is as an antenna array disposed on an airborne vehicle, such as a dirigible. Specifically, in one illustrative embodiment, a plurality of antenna elements, such as antenna element 202 are disposed on the surface of the dirigible. In this case, inner surface 205 may be the external surface of the dirigible that serves to contain the lighter-than-air gas (such as helium or hydrogen) within the interior of the dirigible. Thus, the dirigible could thus be characterized as having a "double-wall" construction wherein the interior wall (e.g., surface 205) and the outer wall (e.g., surface 204) are connected to each other via connecting structures (e.g., connecting tubes 206).

While FIG. 2 shows an enclosed volume supporting the antenna element 202, one skilled in the art will recognize that, as used in a dirigible application, one open-volume inflatable structure can be used to support a large number of antenna elements. As such, in one illustrative embodiment, the volume that results between the inner surface 205/external surface of the dirigible and the outer surface 204 in FIG. 2 may, illustratively, be used as an additional volume of lighter-than-air gas to provide additional lift. Alternatively, in another illustrative embodiment, the volume between inner surface 205 and outer surface 204 may be filled with ambient air or another suitable gas that functions to protect the inner surface 205 from damage caused by lightening or electrostatic discharge. Finally, in another illustrative embodiment, the volume between surfaces 204 and 205 may be filled with a light-weight foam possessing advantageous dielectric properties used to isolate the ground plane (e.g., surface 205) from the antenna element 202. In any of the above-described embodiments, the gas or foam used to fill the volume between inner surface 205 and outer surface 204 may also be selected such that it functions to dissipate the heat generated by the antenna elements and the electronic components associated with those elements.

Figure 3:
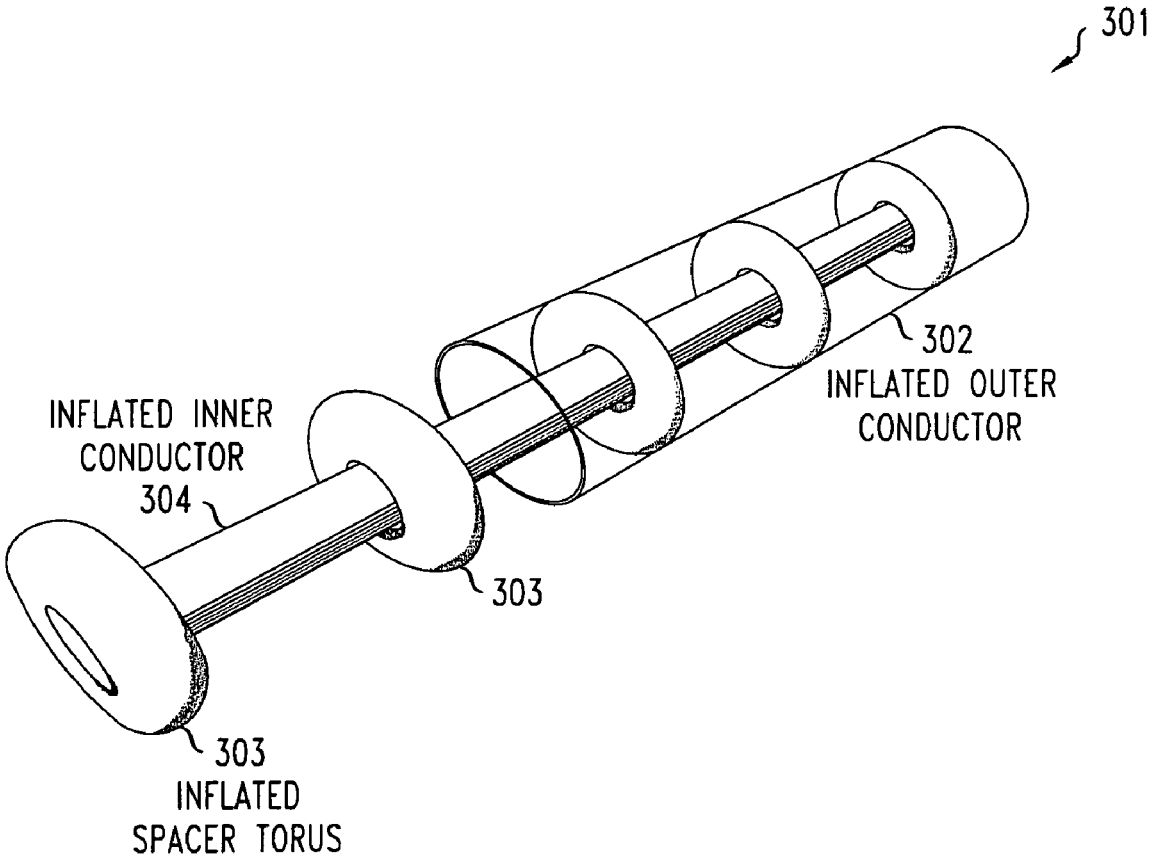
FIG. 3 shows an illustrative light weight coaxial transmission line in accordance with the principles of the present invention.

As discussed above, connecting tubes 206 of FIG. 2 are used to maintain a desired separation distance between outer surface 204 and inner surface 205. However, these tubes may also function as a method of transmitting RF energy to and from signaling electronics. Specifically, in one embodiment, the tubes themselves can be signal conductors by, for example, metallizing the inner surface of the connecting tubes, thus forming circular waveguides. Alternatively, by placing an inner conductor inside the connecting tubes it is possible, by metallizing the connecting tubes, to form a coaxial transmission line which is useful for conducting a wider range of frequencies than a non-coaxial transmission line. One illustrative structure useful in forming such a coaxial transmission line is shown in FIG. 3. Specifically, referring to FIG. 3, an inner conductor 304, illustratively constructed from metallized Mylar film, is disposed within an outer conductor 302 which is, illustratively, a metallized interior surface of connecting tubes 206 in FIG. 2. In one embodiment, a pressurized fluid (such as a gas or a liquid) may be disposed within the outer conductor 302 to keep a desired separation distance between the inner conductor 304 and the outer conductor 304. In another illustrative embodiment, shown in FIG. 3, inner conductor 304 passes through the center of illustrative circular toroid (doughnut)-shaped structures 303, which are, illustratively, inflatable. When inflated, toroid-shaped structures 303 maintain a desired separation distance between inner conductor 304 and outer conductor 302 in order to form, for example, a 50 Ohm impedance transmission line structure 301. Such a transmission line may be used, for example, to transmit RF energy to or from one or more antenna elements. As formed, the transmission line of FIG. 3 is characterized as being of extremely light weight and low cost relative to other transmission lines having similar dimensions.

Figure 4:
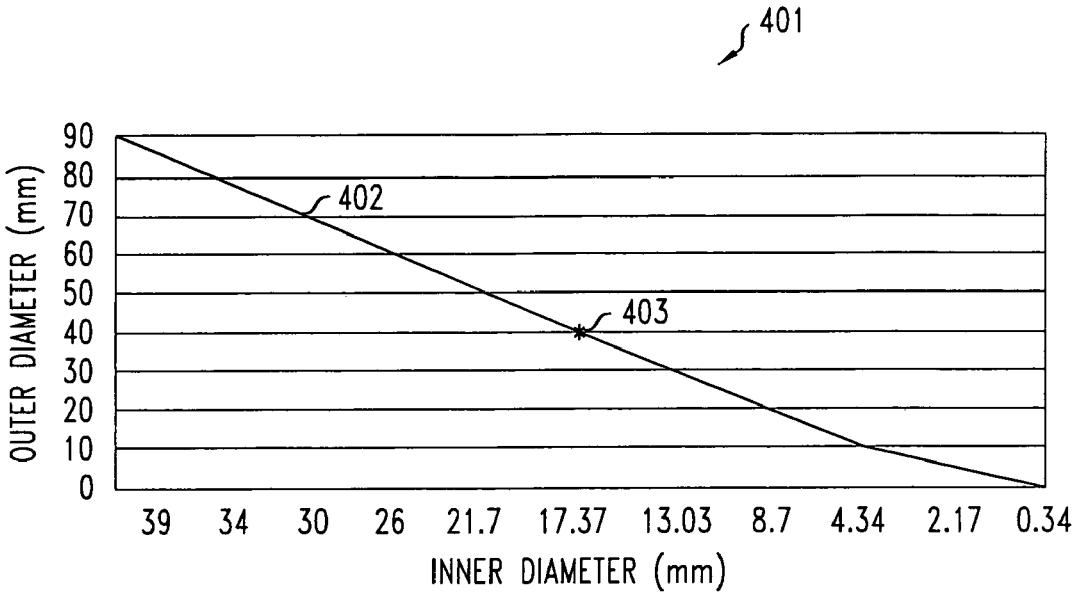
FIG. 4 shows the illustrative inner and outer diameters of the coaxial transmission line of FIG. 3.

FIG. 4 is a graph 401 having plot 402 showing the relationship between the diameters of the inner conductor 304 of FIG. 3 and the outer conductor 302 of FIG. 3 that may be used to create a transmission line such as transmission line 301 having a 50 Ohm impedance. For example, at illustrative point 403, such an impedance will result from an inner conductor having inner diameter of approximately 17.37 mm and an outer conductor having a diameter of approximately 40 mm. One skilled in the art will recognize in light of the graph of FIG. 4 that many advantageous combinations of inner and outer diameters are useful for creating such a 50 Ohm transmission line.

Figure 5:
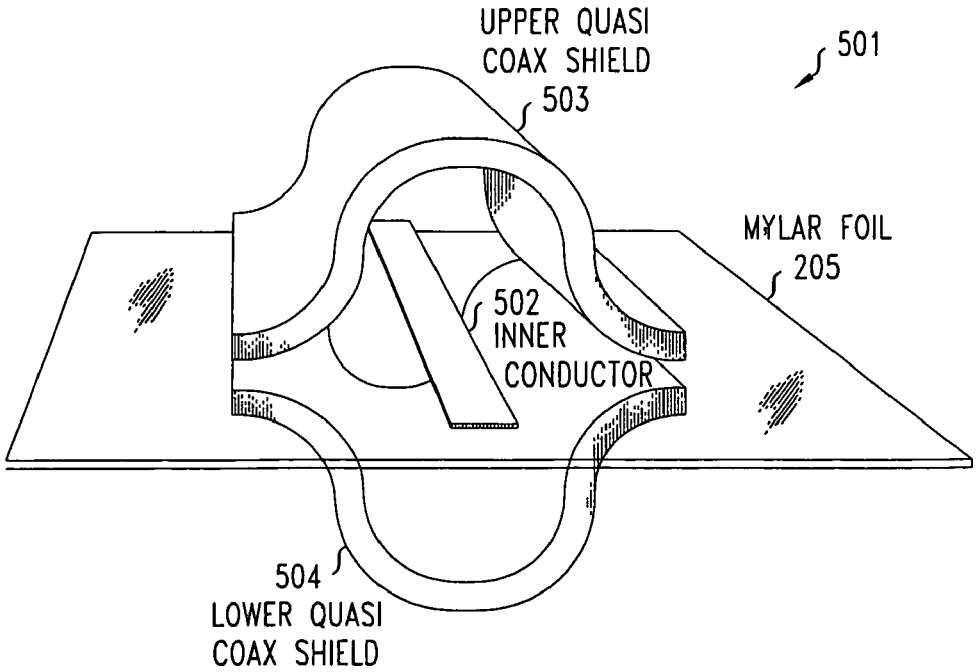
FIG. 5 shows another illustrative coaxial transmission line in accordance with the principles of the present invention.

FIG. 5 shows another embodiment 501 of a transmission line that is useful within an enclosure containing a pressurized fluid, such as the double-walled enclosure formed by using the inflatable structure 201 of FIG. 2 on a lighter than air vehicle. One skilled in the art will recognize that the transmission line of FIG. 5 may be advantageous, for example, for transmitting a signal between two electrical components on the lighter than air vehicle, such as between a signal transceiver and the aforementioned antenna elements that may be disposed on the surface of the vehicle.

Referring now to FIG. 5, that figure shows a quasi-coaxial transmission line having conductor 502 that is, illustratively, a metallized strip disposed on, for example, surface 205 of FIG. 2, which is, in turn, an illustrative Mylar surface. In this illustrative embodiment, an upper coaxial shield covers the upper side of metallized strip 502 and a lower quasi coaxial shield 504 covers the lower side of the metallized strip 502. Both the upper and the lower shields are, illustratively, manufactured from metallized Mylar sheets attached to illustrative surface 205 as shown in FIG. 5 and are electrically connected to each other, for example, through surface 205. One skilled in the art will be able to devise other arrangements of upper and lower quasi coaxial transmission lines 503 and 504 respectively. In one illustrative embodiment, a pressurized fluid, such as helium or hydrogen gas, is used to maintain the separation distance between the coaxial shields 503 and 504 and the metallized strip 502. The transmission line of FIG. 5 is advantageous in that it is extremely light weight relative to prior signal transmission lines and, thus, can be readily formed on the surface of the aforementioned lighter than air vehicles.

The foregoing merely illustrates the principles of the invention. It will thus be appreciated that those skilled in the art will be able to devise various arrangements which, although not explicitly described or shown herein, embody the principles of the invention and are within its spirit and scope. For example, one skilled in the art, in light of the descriptions of the various embodiments herein, will recognize that the principles of the present invention may be utilized in widely disparate fields and applications. Specifically, one skilled in the art will recognize that the transmission lines of FIG. 3 may be useful in any application where light weight and low cost are advantageous. More particularly, such transmission lines may be advantageously used in connecting a base station in a wireless communication system to an antenna on a transmission tower within that system. When used in such a wireless communication system, the fluid used within the outer conductor 302 may be, for example, a lighter than air gas, such as helium. When such a lighter than air gas is used, it can serve as both a dielectric to electrically separate the inner and outer conductors and, at the same time, can function to support the weight of the transmission line.

Similarly, the antenna elements and transmission lines described herein above may be used in widely varied applications. Once again, in the field of wireless communications, temporary base stations may be required, for example, in times of emergency or in particularly high call-volume regions, such as at sporting events. In such uses, an inflatable lighter than air body may have a plurality of antenna elements disposed on the surface of the body and configured with lightweight transmission lines to function as a wireless antenna system. A temporary cell cite may be created for a particular geographic area by positioning the inflatable body above that area, and connecting it to a mobile base station using, for example, the lightweight transmission lines described herein above.

All examples and conditional language recited herein are intended expressly to be only for pedagogical purposes to aid the reader in understanding the principles of the invention and are to be construed as being without limitation to such specifically recited examples and conditions. Moreover, all statements herein reciting aspects and embodiments of the invention, as well as specific examples thereof, are intended to encompass functional equivalents thereof.

What is claimed is:

1. An apparatus comprising:

an inflatable body having an inner surface and an outer surface;

at least one antenna element disposed on said outer surface; and a plurality of support structures passing through portions of said inner surface and supporting and connecting said inner and outer surfaces, and providing a signal connection for the at least one antenna element.

2. The apparatus of claim 1 wherein said inner surface comprises the surface of a dirigible.

3. The apparatus of claim 1 wherein said plurality of support structures comprises a plurality of tubes.

4. The apparatus of claim 3 wherein at least one of said plurality of tubes comprises a coaxial transmission line adapted to transmit signals to and from said at least one antenna element.

5. The apparatus of claim 1, further comprising a plurality of antenna elements having a phased array antenna.

6. An apparatus comprising:

an inflatable body having an inner surface and an outer surface;

at least one antenna element disposed on said outer surface, and a plurality of structures passing through portions of said inner surface and supporting and connecting said inner surface and said outer surface, and providing a signal connection for the at least one antenna element.

* * * * *